US005419165A

United States Patent [19]

Perkins

[11] Patent Number: 5,419,165

[45] Date of Patent: May 30, 1995

[54] ELECTRICAL PANEL LOCKING APPARATUS

[76] Inventor: Jon T. Perkins, 1949 Martina St., Apopka, Fla. 32703

[21] Appl. No.: 163,001

[22] Filed: Dec. 8, 1993

[51] Int. Cl.[6] ..... E05B 65/06

[52] U.S. Cl. ..... 70/14; 70/19; 70/101; 292/258; 292/288

[58] Field of Search ..... 292/288, 258, DIG. 60, 292/259, 338; 70/14, 18, 19, 57, 91, 94, 101, 163, 164, 78; 410/145; 403/108, 109, 379, 378

[56] References Cited

U.S. PATENT DOCUMENTS

| | | | |
|---|---|---|---|
| 2,479,300 | 8/1949 | Binz | 70/19 |
| 2,514,738 | 7/1950 | Bradley | 292/258 |
| 2,529,432 | 11/1950 | Tenner | 70/19 |
| 2,556,900 | 6/1951 | Buschhorn | 70/19 |
| 2,912,268 | 11/1959 | Markovich . | |
| 3,273,935 | 9/1966 | Carson | 292/288 |
| 3,665,736 | 5/1972 | Wilson | 70/78 |
| 4,389,862 | 6/1983 | Hastings | 70/19 |
| 4,788,840 | 12/1988 | Wilson, Jr. | 70/164 |
| 4,958,867 | 9/1990 | Champagne | 292/258 |
| 5,209,533 | 5/1993 | Menard | 292/258 |

*Primary Examiner*—Peter M. Cuomo
*Assistant Examiner*—Darnell M. Boucher
*Attorney, Agent, or Firm*—William M. Hobby, III

[57] ABSTRACT

An electrical panel locking apparatus includes first and second elongated angle iron bars having panel gripping hooks on one end of each elongated bar. One of the elongated bars has a flanged end portion with an angled slot therethrough for sliding the other elongated bar so that one telescopes inside the other and each angle iron elongated bar has a plurality of openings therein so that openings in one bar can be aligned with the openings in another bar for inserting the shackle of a padlock to lock the bars together. Thus, the hooks on each bar connect to either side of the front panel of an electric box and each has an off-set angle to allow the locking bars to fit over the panel door. The elongated bars can be telescoped to clip around the edges of any size panel and over the panel door and locked in position.

8 Claims, 1 Drawing Sheet

ELECTRICAL PANEL LOCKING APPARATUS

BACKGROUND OF THE INVENTION

The present invention relates to an electrical panel locking apparatus and especially to an apparatus for locking an electrical panel door closed while electrical wiring is being modified or repaired.

In the past, it has been common for electricians and repairmen to use the main electrical panel box of a building to disengage one circuit or all the circuits of a building during the making of repairs or additions to the electrical system. This has presented a problem in that main switch boxes are frequently located in garages or remote areas while the work being performed on the electrical system is located in a remote area from the panel box. Thus, anyone in the building seeing that the power has been disengaged can open the panel box and reconnect the panel circuit while the electrician or repairman is working thereon and thus present an electrical hazard. To overcome this type of an electrical hazard, it has been suggested that once an electrical circuit has been disengaged, that the panel door on the electrical box be locked. Some electrical boxes do have key locks for the door and some have openings which provide for a shackle type lock to lock the boxes. This has proven to be inadequate in that boxes having a built-in lock requires that the key be available and on other types of electrical boxes, they usually do not have padlocks attached to them. The main panel box for a building is usually located outside so that in the case of a fire or similar situation, access can be obtained to the electrical box readily to turn off the power to a building without having to enter the building. These boxes, however, typically only turn the power off for the entire building. The present invention is a locking system for use by electricians made to universally fit electrical front panels for locking the panel door closed while work is being done upon the electrical circuits.

Prior art patents which use some types of bars for locking an access opening for preventing entry thereinto can be seen in the U.S. Pat. No. 4,788,840, to Wilson, Jr., for a bung plug locking device which attaches to a drum for locking the bung in place. It has a pair of telescoping bars, one telescoping relative to the other and one adapted to be used with a matching bung having a hasp-like connection which will accept a padlock. In the U.S. Pat. No. 5,103,659, to Benefield, Sr., a locking device for mailboxes is shown in which a bar is hingedly attached in one embodiment but in another embodiment merely locks on either end across a series of adjacent mailboxes. In the Blair et al. patent, U.S. Pat. No. 5,077,993, an electrical power meter box lock has a solid rod with a flared head to engage spring steel blades for locking a meter box. In the prior U.S. Pat. No. 4,194,775, to Shea, a fastener for a pay telephone station coin box has a hasp type lock attached to a pay phone. In the Soehner et al. patent, U.S. Pat. No. 4,986,096, an access cover security device is illustrated for securely locking the access cover to a housing, such as in an electrical meter. In the Blair et al. patent, U.S. Pat. No. 4,945,738, a meter box lock is provided for securely closing a commercial electric power meter box at the front of the meter box. The Moberg patent, U.S. Pat. No. 4,329,860, has a front entry electric meter locking assembly. The Granda patent, U.S. Pat. No. 3,621,687, is a padlock installation in which the door itself operates similar to a hasp. In the Swiss patent, No. 101,912 to Ritter, a strap lock for a storage container is shown.

In contrast to these prior art devices, the present invention is a universal electrical panel locking device which readily attaches to any size electrical box front panel and allows the panel door to be securely locked with a conventional padlock and can be carried with an electrician or anyone that works on electrical circuits and which can be rapidly attached to the panel box after the circuits that are being worked upon have the circuit breakers opened.

SUMMARY OF THE INVENTION

An electrical panel locking apparatus includes first and second elongated angle iron bars having panel gripping hooks on one end of each elongated bar. One of the elongated bars has a flanged end portion with an angled slot therethrough for sliding the other elongated bar therein so that one telescopes inside the other. Each angle iron elongated bar has a plurality of openings therein so that openings in one bar can be aligned with openings in the other bar for inserting a padlock shackle to lock the bars together. Thus, the hooks on each bar grasp the edge of each side of the front panel of an electric box and each has an off-set angle to allow the locking bars to fit over the panel door. The elongated bars can be telescoped to clip around the edges of any size panel and over the panel door and locked in position thereover.

BRIEF DESCRIPTION OF THE DRAWING

Other objects, features and advantages of the present invention will be apparent from the written description and the drawings in which.

DESCRIPTION OF THE PREFERRED EMBODIMENT

Figure 1:
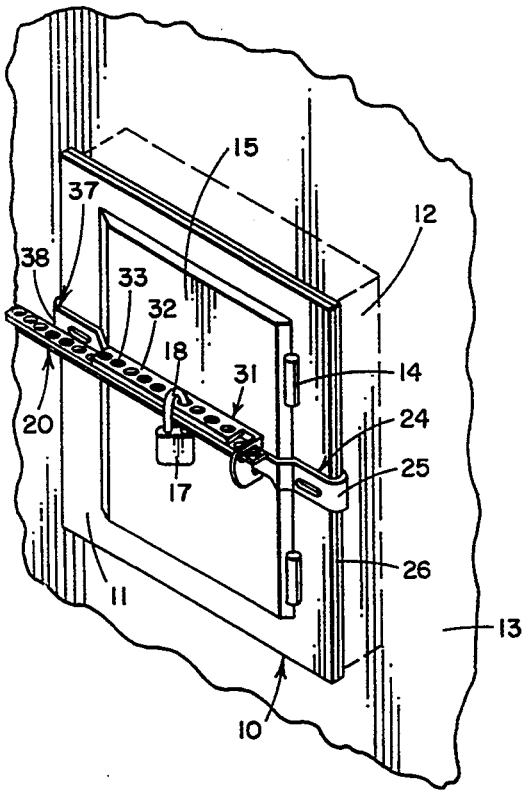
FIG. 1 is a perspective view of an electrical panel box having a locking apparatus in accordance with the present invention attached thereto.
Figure 3:
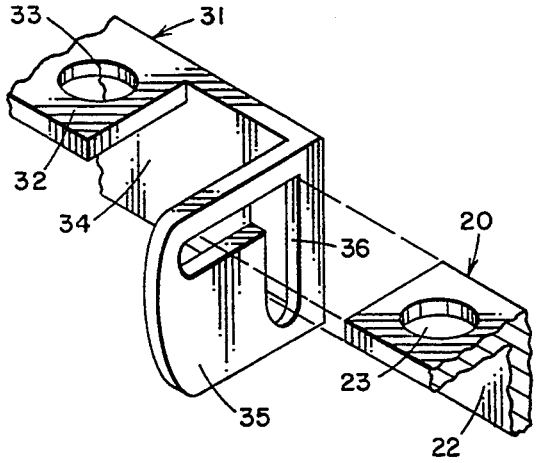
FIG. 3 is a perspective view of the bar slide coupling in accordance with FIGS. 1 and 2.
Figure 2:
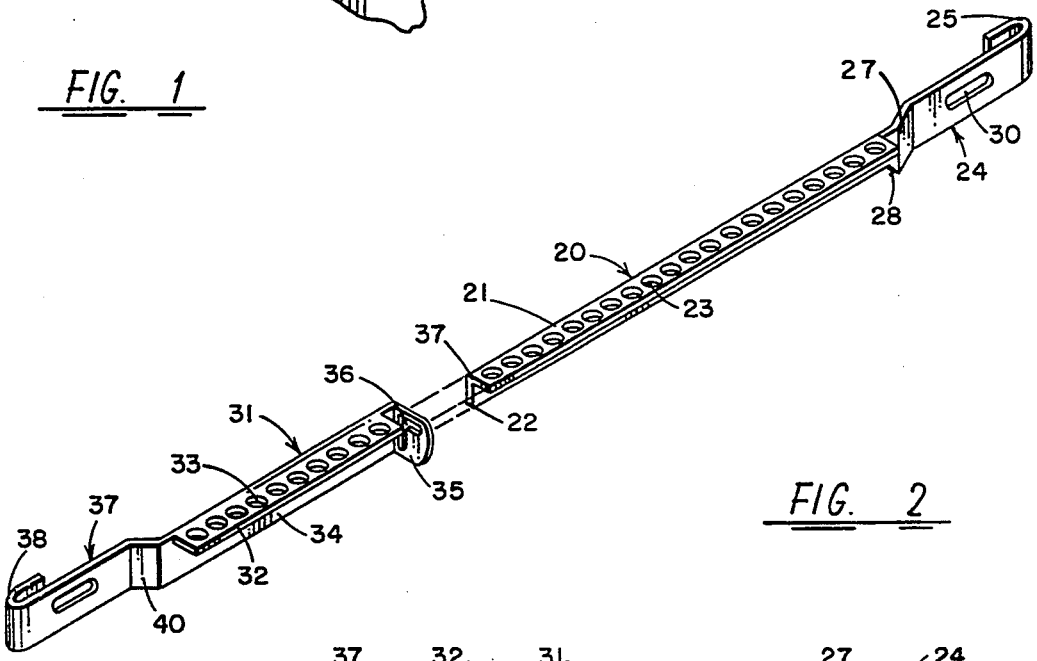
FIG. 2 is an exploded perspective view of an electrical panel locking apparatus in accordance with FIG. 1.
Figure 4:
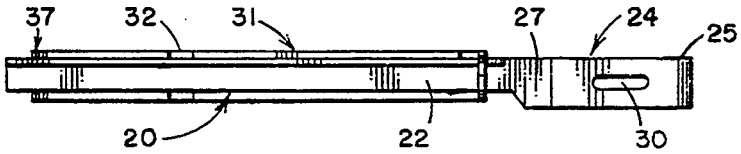
FIG. 4 is a side elevation of the electrical panel locking apparatus in accordance with FIGS. 1–3.

Referring to FIGS. 1–4 of the drawings, an electrical panel box 10 includes electrical circuit box 12 mounted in a wall 13 and having a panel cover 11 which can be bolted to the wall if desired and has a door 15 hinged with hinges 14 to the front panel 11 for easy access to the circuit breakers in the box 12. The present invention relates to a panel box door locking mechanism 16 which attaches across the front panel 11 and door 15 and is locked thereto with a padlock 17 having a shackle 18 locking the mechanism 16 in place. The locking mechanism has a first elongated locking bar 20 which is an angle iron having one angled surface 21 and a second 90° or perpendicular flat bar 22. The one side 21 has a plurality of openings 23 equally positioned therealong and at one end thereof has a panel grasping member 24 including a grasping hook 25 adapted to fit around the edge 26 of a panel 11 cover and then having an angled offset portion 27 for raising the angle iron elongated bar portion 20 over a panel door 15. The angled portion also has ledges 28 formed thereon while the clasping portion 24 has an elongated slot 30 therein which can be used with the panel screws to hold the locking mechanism 16 in position. A second elongated angle iron member 31 has one angle surface 32 having a plurality of openings 33 therein and a second solid side 34. The elongated bar 31 has an end flange portion 35 having an angled slot 36 having a 90° angle therein for exactly receiving the end cross-section portion 37 of the angle iron elongated bar 20 so that the bar 20 can telescope on the bar 31 by sliding in and out of the slot 36 in the flange portion 35. The elongated bar 31 has a panel grasping end 37 similar to the panel grasping end 24 of the elongated bar 20 and has a panel grasping hook portion 38. The flat grasping portion 37 has a raised or bent portion 40 where it attaches to the elongated angle iron member 34 similar to the bent portion 27 of the elongated bar 20.

In operation, the members 20 and 31 are slidable coupled together in a telescoping fashion with the elongated member 20 telescoping through the slot 36 to adjust for size with the angles of the angle iron portion of the elongated bar 20 and 31 matching so as to slide one angle iron member within the angle of the other angle iron member. The members are clasped on the edge 26 of the panel 11 of the electrical box on both sides and slid to their clasp type thereon and openings 23 of elongated bar 20 and openings 33 of the elongated bar 31 are aligned for the padlock 17 to allow the shackle 18 to slide between two openings and lock the bars 20 and 31 together to prevent removal of the locking mechanism 16 from the front electrical panel 11.

It should be clear at this time that an electrical panel locking apparatus has been provided which will universally fit most electrical panel face plates to lock the panel door in place. However, the present invention should not be considered limited to the forms shown which are to be considered illustrative rather than restrictive.

I claim:

1. An electrical panel locking apparatus comprising:

a first elongated bar having a panel gripping hook on one end portion thereof, said first elongated bar having a portion thereof with a generally angle iron cross section;

a second elongated bar having a panel gripping hook on one end portion thereof and having an angle iron cross section opening in the other end portion thereof shaped to receive said first elongated bar angle iron cross section portion therein and said second elongated bar having a perpendicular flange thereon having said angle iron cross-section opening therein for receiving said first elongated bar therethrough;

a locking mechanism; and said first and second elongated bars each having at least one opening therein which are alignable for locking said elongated bars together with said locking mechanism, whereby said first and second elongated bars can be attached over an electrical panel door and locked together over said panel door.

2. An electrical panel locking apparatus in accordance with claim 1 in which said locking mechanism is a padlock having a shackle locking said first and second elongated bars together.

3. An electrical panel locking apparatus in accordance with claim 2 in which said first and second elongated bars each have a bend therein at a predetermined point to raise a portion of said first and second elongated bars over said electrical panel door when each said elongated bar hook is attached to an electrical panel cover.

4. An electrical panel locking apparatus in accordance with claim 3 in which said each of said first and second elongated bars have a plurality of openings therein for alignment in different positions for said locking mechanism to fit different size electrical panels.

5. An electrical panel locking apparatus in accordance with claim 4 in which said second elongated bar has a stop ledge formed thereon to block said second bar against said first elongated bar flange at a predetermined point.

6. An electrical panel locking apparatus in accordance with claim 2 in which said second elongated bar flange opening is a generally ninety degree slot therethrough.

7. An electrical panel locking apparatus in accordance with claim 6 in which each said elongated bar has an elongated opening therethrough adjacent said hook end positioned for receiving the screws of said electrical panel to hold said panel locking apparatus in place.

8. An electrical panel locking apparatus in accordance with claim 7 in which said second elongated bar angled opening is positioned so that the angle of said first and second elongated bars fit together one angle inside the other.

* * * * *